United States Patent [19]

Rogers

[11] 4,183,315

[45] Jan. 15, 1980

[54] METHOD AND APPARATUS FOR MAKING A CAN END SEAM

[75] Inventor: Roy E. Rogers, Longview, Wash.

[73] Assignee: Weyerhaeuser Company, Tacoma, Wash.

[21] Appl. No.: 948,316

[22] Filed: Oct. 3, 1978

Related U.S. Application Data

[63] Continuation of Ser. No. 828,572, Aug. 29, 1977, abandoned.

[51] Int. Cl.[2] ..... B21D 37/00

[52] U.S. Cl. ..... 113/18 R; 113/1 E; 113/120 Y; 113/121 A

[58] Field of Search ..... 113/1 E, 16, 18 R, 18 C, 113/120 R, 120 K, 120 Y, 121 R, 121 A, 121 C, 30; 220/67; 229/5.6

[56] References Cited

U.S. PATENT DOCUMENTS

| | | | |
|---|---|---|---|
| 3,385,249 | 5/1968 | Czarnecki | 113/120 R |
| 3,556,031 | 1/1971 | Frankenberg | 113/30 |
| 3,908,572 | 9/1975 | Johnson et al. | 113/1 E |
| 4,055,133 | 10/1977 | Wessely | 113/120 Y |

*Primary Examiner*—Leon Gilden

[57] ABSTRACT

A method and apparatus for attaching an end closure to a cylindrical can body utilizes a tooling arrangement whereby the closure is positioned and compressed through side pressure while the seam is then formed through vertical pressure, producing a double seam. A base plate moves a can body with an end closure into position for attachment where a set of radially movable curling fingers are movable inwardly to a position against the end closure and can body in a slidable relationship therewith. After the curling fingers are in position, the required curling is accomplished when a punch member moves downward relative to the curling fingers and forces the circumferential edge of the end closure into a curled relationship with a downwardly extending flange on the can body. Once the end seam is formed, the punch retracts, releasing the closed can by causing the base plate to raise slightly to permit the curling fingers to retract, thereby releasing the bottom portion of the double seam after which the base plate is lowered. A suitable sealing compound may be used between the closure and the can body flange, thereby forming a tight, hermetically sealed end seam.

8 Claims, 8 Drawing Figures

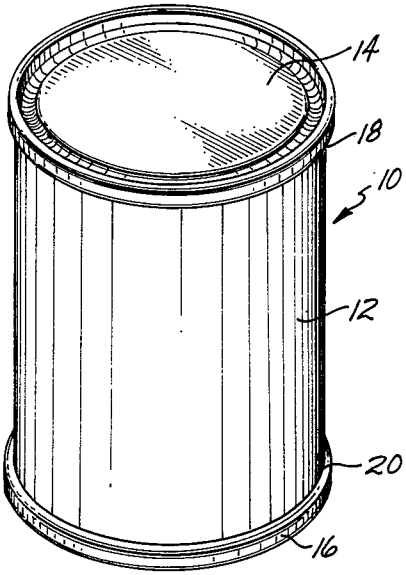
Fig. 1
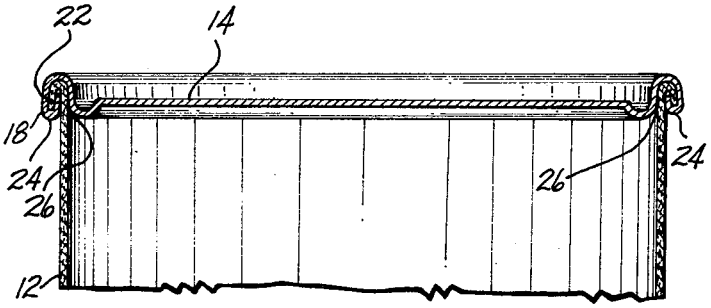
Fig. 2
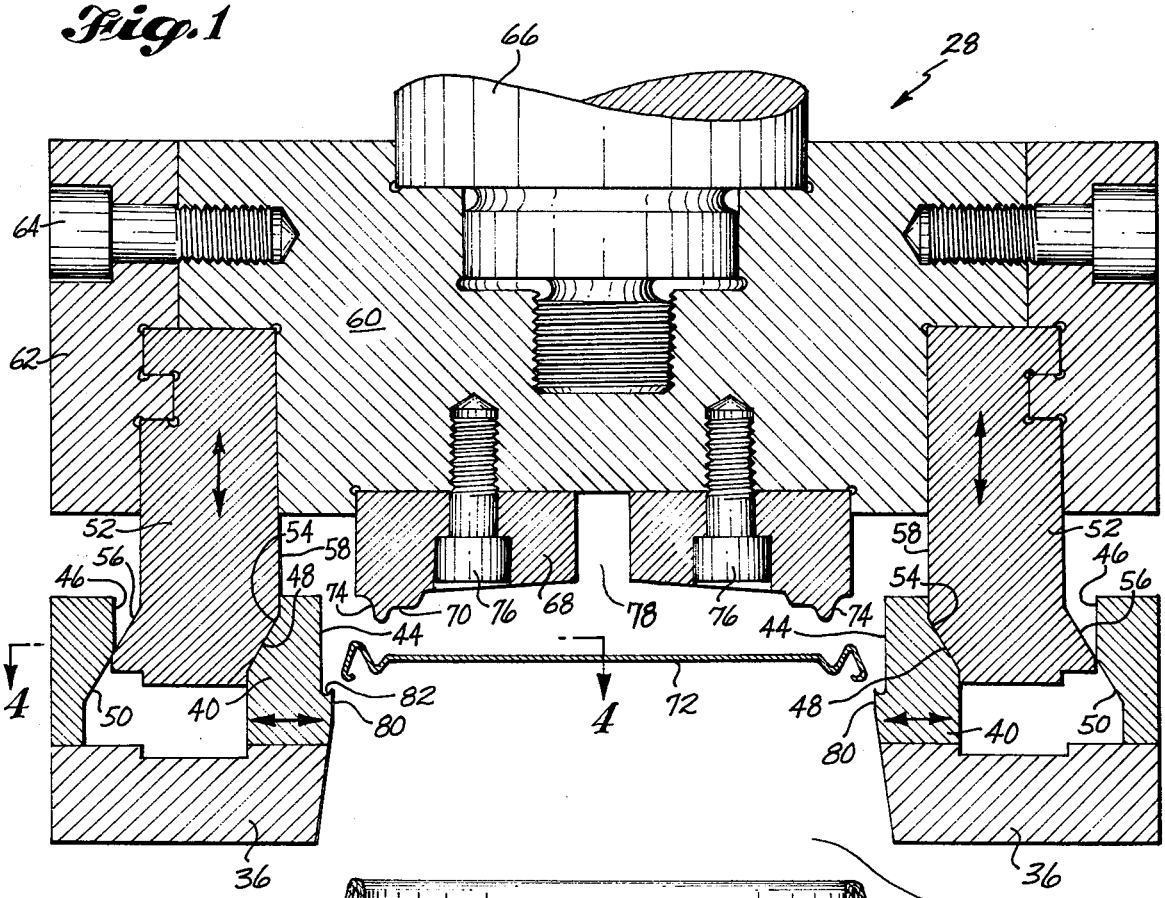
Fig. 3
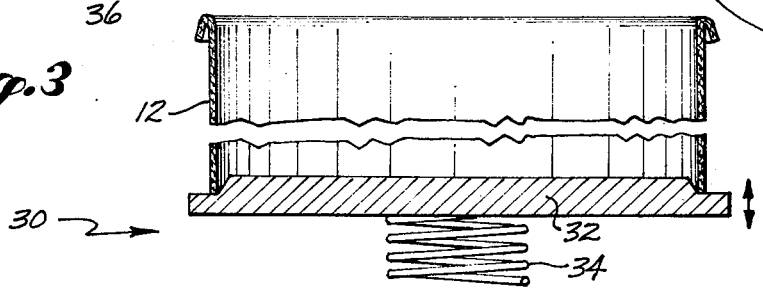

METHOD AND APPARATUS FOR MAKING A CAN END SEAM

This is a continuation of application Ser. No. 828,572 filed Aug. 29, 1977 now abandoned.

BACKGROUND OF THE INVENTION

This invention relates generally to attaching ends to can bodies and more particularly to a process and apparatus for pressing can ends onto can bodies and forming a tight, hermetic, curled double seam.

In manufacturing cans, high-speed automatic machinery is utilized for high-production rates. Once a can body is formed, one end is then attached prior to attaching a second end and filling. End closures can be attached to can bodies in a number of different ways but most require bending of the can material into a mechanical joint such as by curling an edge of the end closure into the opening between a flanged edge of the can body and the can body itself, using a side pressure. Oftentimes a suitable sealing compound is inserted within the joint or seam to form a hermetically sealed end. When one end is attached to a can body or if a can body is a single piece body, it can then be filled with suitable product and finally closed for packaging and shipment.

The most common method of forming hermetic double-end seams is by "roll" seaming, using a side pressure. Roll seaming requires that the can be made to revolve by being driven with a chuck after which "seaming rolls" are caused to advance toward the curl of the can end and roll the curl end to the can body so as to form a mechanical lock. Another alternative often used is to hold the can in a stationary position, again using a seaming chuck, and to cause the seaming rolls to revolve about the can end, after which the seaming rolls are caused to advance and to roll in the curl flange of the can end, using a side pressure. Similarly, this method also forms a mechanical lock with the can body. Using these end-attachment methods, either the can itself or the seaming rolls which iron the curl end to the can body are caused to revolve at high speeds. With either of these methods, there is a limitation as to the number of cans which may be closed (or seamed). This limit is imposed for a number of reasons. In the case where the can is caused to revolve, the cans must be automatically fed into the closing machine and caused to be accelerated radially at high speeds. Also, when a base plate, the bottom portion of the tooling which picks the can body up and raises it to the seaming position, is rotating rapidly and when a body is fed onto a base plate, they "chatter" and become unstable. When cans with thick side seams are rotating at high speeds, they often cause the seaming rolls to skip while forming the end seam. Another problem is that the side pressure from the seaming rolls used to iron the end seam down is oftentimes excessive, causing bearings to wear out rapidly.

Others have considered the aforenoted problems with roll seaming and two examples of press forming of the seams may be seen by referring to U.S. Pat. No. 3,385,249—Czarnecki, and U.S. Pat. No. 3,908,572—Johnson et al. The Czarnecki patent discloses an end seaming process and apparatus for forming a mechanical joint having a gap within the seam. By providing the annular gap, it is apparent that no side or vertical compressive forces are applied to form a flat, tight joint. The joint formed by Czarnecki does not result in a tight, well-sealed joint and would not withstand particularly high internal pressures. The Johnson et al disclosure (see particularly FIGS. 10 and 11) shows an end closing process and apparatus where radially moving fingers press the edge of a can end in against the can body; however, the edge is not curled upwardly into a flange portion on the can body. Johnson et al does disclose an overall end closing method and apparatus with certain elements being adaptable for use with the present invention. For example, the tooling comprising the machine portion of the present invention could be individually mounted on a typical rotating turret used in high-speed can closing operations. A plurality of individual closing devices are commonly mounted about the circumference of the typical turret and are functionally operable through cams rolling on circular, suitably contoured cam rings.

Accordingly, from the foregoing, one object of the present invention is to provide a can end closing method and apparatus that is operable at high speeds without the aforementioned typical problems with roll seaming.

Another object of the invention is to form a pressed hermetic double-end seam that is tight and firmly locked.

Still a further object of this invention is to provide a closing apparatus that is adaptable for use with currently available machine systems.

These and other objects will become more apparent upon reading the specification to follow in conjunction with the attached drawings.

SUMMARY OF THE INVENTION

Briefly stated, the invention is practiced in one form by moving a can body toward a closing device where a precontoured can end will be appropriately positioned with respect to the flanged end of the body. A spring-mounted base plate moves the body and end toward a contoured punch and curling assembly at which time the punch member then begins its movement toward the base plate. This action moves the end and body downwardly toward the curling fingers of the curling member after they have been moved radially inward so as to slidably engage the body side wall. The punch member continues its downward movement, forcing the end closure edge to turn upwardly in the grooves on the curling fingers where it engages the annular slot within the flange portion of the can body. A sealing compound can be prepositioned within the annular joint, thereby resulting in a pressed hermetic double-end seam. Release of the closed can body is effected by retracting the punch member, lifting the can body slightly, moving the curling fingers radially outward, and then lowering the base plate to its retracted position.

BRIEF DESCRIPTION OF THE DRAWINGS

FIG. 1 is a perspective view of a typical cylindrical closed can having a pressed double-end seam constructed according to the present invention.

FIG. 2 is a cross-sectional view through the double-end seam.

FIG. 3 is a cross-sectional view through the closing apparatus of the present invention and shows all moving elements retracted.

DESCRIPTION OF A PREFERRED EMBODIMENT

Figure 4:
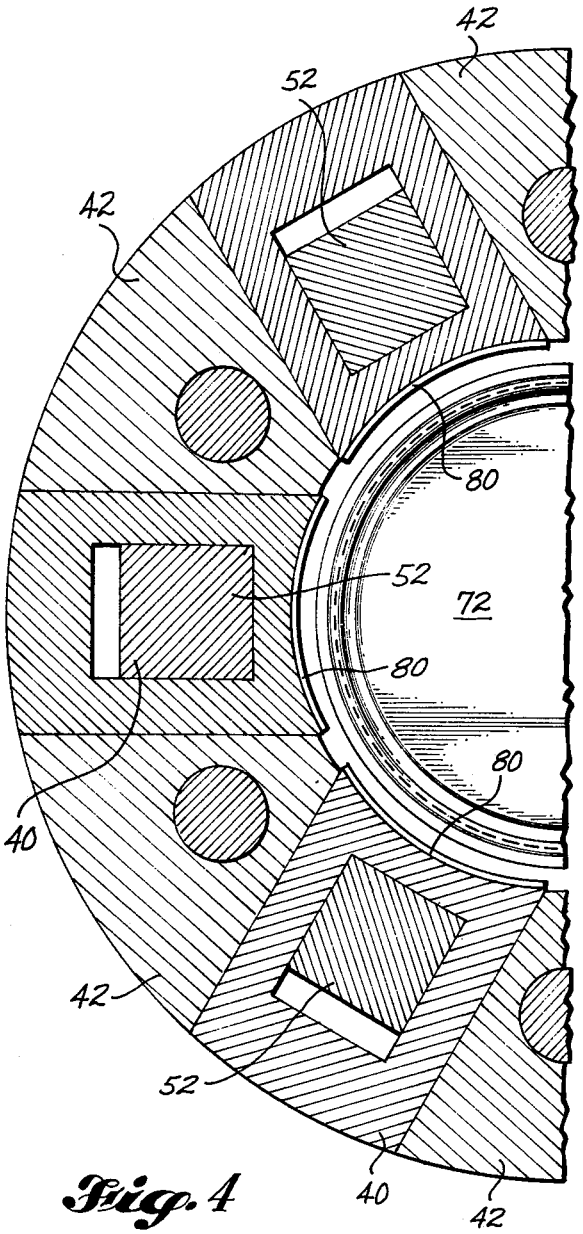
FIG. 4 is a cross-sectional view taken along line 4—4 of FIG. 3 showing the plan arrangement of elements in their retracted positions.

Referring first to FIGS. 1 and 2, a typical cylindrical closed can is generally indicated at 10. Can 10 is typical in that it is comprised of three parts: a cylindrical can body 12, a top end closure 14, and a bottom end closure 16. Usually the can body 12 has a side seam if it is made from flat stock (not shown), while the top and bottom end closures 14, 16 are joined to body 12 at top and bottom end seams 18, 20 respectively. A cross-section through a typical well-known double-end seam is shown in FIG. 2 and includes a circumferentially extending wiped-down flange 22 formed by the top edge of can body 12 together with a circumferentially extending curled edge 24 formed from the outermost periphery of an end closure. The flange 22 and curled edge 24 are interlocked mechanically and may include a suitable sealing compound indicated at 26. These typical end seams, when formed of suitable structural design and with suitable operating parameters, are hermetically sealed and form a tight joint suitable for holding a product over extended periods of time.

Turning now to FIG. 3, a description will be given of a single closing apparatus or device capable of practicing the closing method of the present invention. While only a single closing apparatus is depicted for descriptive purposes, it will be readily understood by those skilled in the can-closing art that for a high-speed production system a plurality of single closing devices may be mounted on a turret type closing assembly. A starwheel, for example, could then feed individual can bodies and an end closure sequentially into the system for closing by the individual closing devices. By mounting a plurality of closing devices circumferentially about a turret assembly, high-production rates can be obtained. An example, by utilizing the present invention and a plurality of twelve individual closing devices mounted in a turret assembly, is that approximately 2,000 can ends per minute may be closed.

Each individual closing device is comprised of two vertically spaced cooperating assemblies with the upper assembly being the punch and curling finger assembly generally indicated at 28 and the bottom assembly being the base and positioning assembly generally indicated at 30. The punch and curling and the base and positioning assemblies 28, 30 are vertically spaced a distance that is slightly greater than the length of a can body 12. The base and positioning assembly 30 includes a vertically movable spring-biased base plate 32 atop which rests can body 12 during the seaming operation. Base plates of the configuration shown in the figures are well known and are adaptable to various can closing systems based on the size of the can to be closed. Not shown in the figures is the mechanism for providing the vertical movement to base plate 32. A suitable cam roller and follower mechanism could be provided that would raise and lower the vertical height of a can body sitting atop base plate 32. Of course, it will be recognized by those skilled in the art that the vertical height adjustment will be designed so as to allow easy, trouble-free feeding of can bodies to the base plate 32 when in the lower retracted position and then for raising the top edge of can body 12 to the appropriate position within the punch and curling finger assembly 28. The biasing means provided by spring 34 serves to urge the base plate and can body to its extended height while a downwardly extending force moves it downwardly.

The actual seaming method occurs within the punch and curling finger assembly 28 and is provided by the various elements within the assembly, each performing a specified function within close tolerances. Supporting, in part, the punch and curling finger assembly 28 in its appropriate spatial orientation is an annular combination support and guide ring 36. Ring 36 is fixed in position through a supporting structure (not shown) and has an opening generally indicated at 38 having a diameter somewhat larger than the diameter of can body 12 to be closed. Slidably mounted for movement in a horizontal plane atop guide ring 36 are the plurality of individual curling fingers 40. Curling fingers 40 are adapted to slide radially in a reciprocating manner between circumferentially spaced sector-shaped guide blocks 42. The curling fingers 40 have curvilinear shaped inner faces 44 that can be positioned radially at their extended positions so as to form a circle concentric with a cylindrical can body 12. In their retracted positions, the inner faces 44 of curling fingers 40 will be approximately adjacent the radially inner edge of guide ring 36, allowing free travel of can body 12 upwardly into the punch and curling assembly 28.

Within each curling finger 40 are apertures 46 which are appropriately designed and structured to provide radially inner and outer cam surfaces 48, 50 against which slides the individual downwardly extending reciprocating cam followers 52. Cam followers 52 have inner and outer faces 54, 56 respectively corresponding to cam surfaces 48, 50. Cam surfaces 48, 50 are inclined from the vertical and when cam followers 52 are moved downwardly, the inner and outer faces 54, 56 will be in sliding contact with surfaces 48, 50, causing each curling finger 40 to move radially inwardly toward the vertical center line of punch and curling finger assembly 28. The horizontal planar projections of the inclined inner and outer faces 54, 56 are sized to provide the precise radial travel distance for the innermost faces 44 of curling fingers 40. As will be further described later, the innermost faces 58 on the cam followers 52 function to hold the fingers 40 in their innermost radial position when the followers 52 are at their bottommost position. Of course, it will be recognized by those skilled in the art that the machine tolerances for mating surfaces in the tooling will be very precise.

Cam followers 52 extend upwardly where they are firmly attached to a cylindrically shaped base member 60 of the punch and curling finger assembly 28. Cam followers 52 are attached to base member 60 through appropriately positioned attachment flanges 62 which are in turn held to base member 60 through bolts 64. Attachment flanges 62 are provided for easy removal of cam followers 52 should a dimensional change be necessary due, for example, to a change in the can size to be closed.

Figure 5:
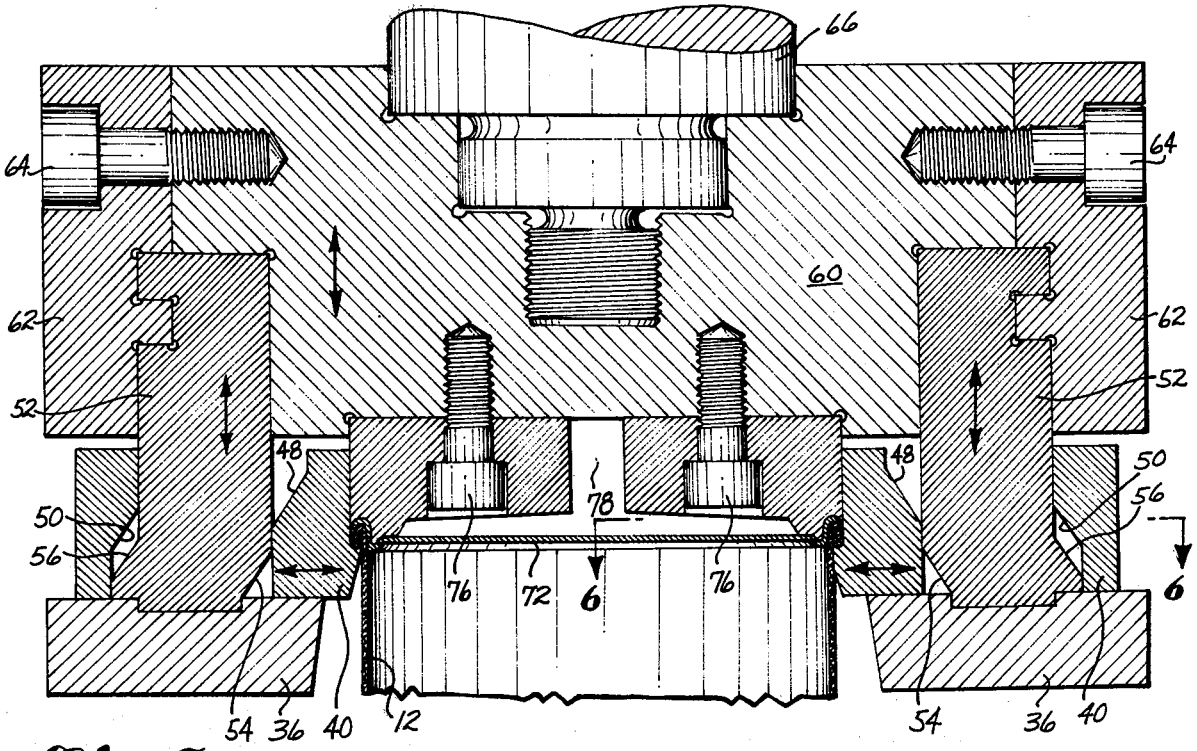
FIG. 5 is a view similar to FIG. 3 showing the elements in a pressing relationship with a can body and end.

Base member 60 is movable vertically in a reciprocable manner through a powered attachment shaft 66. The attachment shaft 66 is firmly fixed to base member 60 and is caused to reciprocate vertically between the upper retracted position as depicted in FIG. 3 and an extended lower position as depicted in FIG. 5. As previously mentioned, vertical reciprocation can be provided by a suitable camming mechanism well known in the art and which would be positioned above the attachment shaft 66. Positioned on the lower face of base member 60 and substantially within the central portion thereof is the precisely machined punch member 68. Punch member 68 is similar to those that are now utilized in can closing processes, in that its lowermost surface 70 is contoured to substantially match the contour of a partially formed end closure. During a portion of the closing process, the lowermost surface 70 will physically contact the end closure and provide a backing pressure for it as the seaming process is carried out. For descriptive purposes, the end closure in FIGS. 3–8 is indicated as 72. The diameter of punch member 68 is slightly greater than the diameter of can body 12 and along the lowermost peripheral edge is an upwardly and outwardly curved relief 74. Relief 74 is provided to accommodate the top portion of curled edge 24 as will become more apparent later. Another feature of punch member 68 is that it is firmly fixed to base member 60 through an appropriate number of upwardly extending bolts 76. A central aperture 78 is provided within the punch member through which a jet of air may be directed or where a knock-out pad (not shown) may be positioned. The air jet or knock-out pad functions to force a closed can downwardly and away from its previous position within punch and curling assembly 28.

Positioned across each inner face 44 of fingers 40 and having a uniform curvilinear shape are the curling grooves 80. Each groove 80 forms an arc of an annular groove formed by all grooves when they are in their innermost radially extended positions. A portion of each groove 80 is in the form of a relief structure 82.

Figure 6:
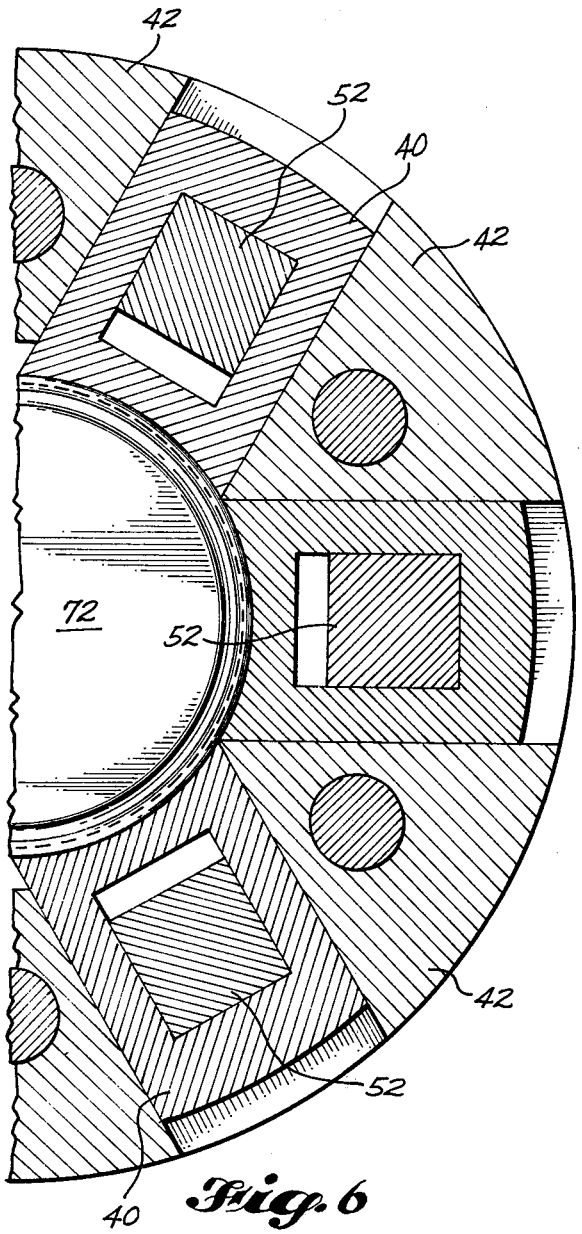
FIG. 6 is a view similar to FIG. 4 taken along line 6—6 of FIG. 5.

Just as the relief 74 is designed to accommodate the contour of the upper portion of curled edge 24 for the application of a downward force, so too is the structure of the grooves 80 designed to accommodate the free edge and a short curl to be formed on the end closure. Since the curling fingers 40 are sectioned, each groove 80 will be uniformly sized and at the proper vertical height in order to form an annular groove. By referring to FIGS. 4 and 6, the curvilinear grooves 80 and the reliefs 82 thereon may be seen in both their retracted and extended positions. FIG. 6 shows the annular groove formed when the curling fingers are in their radially innermost positions.

METHOD OF OPERATION

Figure 7:
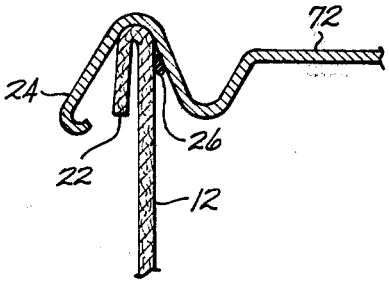
FIG. 7 is a cross-sectional view showing the flange portion of the can body with its annular slot and the precontoured portion of the end closure before seaming.

The first step in closing and hermetically seaming a can is to place a cylindrical can body having a wiped-down flange around its top edge with the configuration shown in FIG. 7 atop the biased base plate 32 when it is in its lowermost retracted position. As previously noted, such positioning procedures are well known in the art and may be accomplished by starwheels, pusher arms or other suitable automatic mechanisms. The can body will have loosely placed over its top edge a preformed end closure having at least a partially curled edge.

At this instant in time, the punch and curling finger assembly 28 has all of its elements in their retracted positions with the punch member 68 being in its uppermost position and with the curling fingers 40 in their radially outermost positions. The closing sequence begins by moving the can body and end closure upwardly into the punch and curling finger assembly to a position where the end closure is vertically above the curling grooves 80 and slightly below the surface 70 of punch member 68. When the can body and end closure is in position, the powered shaft 66 is actuated and begins its downward movement, thereby causing powered cam followers 52 to begin sliding curling fingers 40 radially inwardly to a position where the inner faces 44 of fingers 40 contact the end closure and force it inwardly slightly. The cam followers 52 continue their downward movement while holding the curling fingers 40 fixed in place atop support and guide ring 36. Of course, since punch member 68 is attached to base member 60, it will continue to move downwardly sliding along the inner faces 44 of curling fingers 40. The combination of the punch member configuration and cam follower configuration causes the annular relief 74 to force the edge of the end closure downwardly with sufficient pressure to cause the extreme edge of the end closure to curl around grooves 80 and upwardly into the annular slot formed by the wiped-down flange. A suitable compressive force is exerted to tightly join the end closure to the can body and, if a sealing compound is utilized, a tight, hermetically sealed end seam is formed. A sufficient force exerted by punch member 68 is, for example, within the range of from 1,500 pounds up to about 2,500 pounds consistent with the type of material comprising the can body and end closure. Also, it should be appreciated by those skilled in the art that all tolerances will be determined in part by the thicknesses of the can body and end closure.

Figure 8:
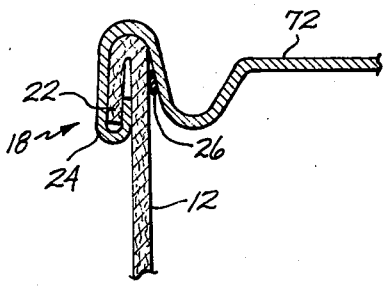
FIG. 8 is a view similar to FIG. 7 but shows a completed pressed double-end seam in detail.

At this instant in time, the hermetically sealed end seam has been formed and the composite can body and end closure must be expediently removed from the punch and curling finger assembly and quickly moved to the next station. First, the powered attachment shaft 66 will begin moving upwardly, causing the punch member 68 to begin its upward travel. Since the base plate is upwardly biased, it will cause the can body and end closure to move slightly upwardly out of the curling grooves. As the punch member 60 continues its upward movement, the cam followers 52 will then begin sliding the curling fingers 40 radially outwardly to their retracted positions. At this point in time with the can body and the end closure now clear from the assembly 28, the base plate 32 is actuated to move vertically downward to its retracted position. At this point, a starwheel or other suitable can moving device may be actuated to remove the closed can body from base plate 32. The next can body and end closure assembly is then placed atop the base plate and the process is repeated. FIGS. 7 and 8 illustrate in detailed form the general design configuration for the can body and end closure, before closure and after closure respectively.

While detailed descriptions of the process and apparatus have been given, it is to be understood that many changes and modifications can be made by those skilled in the art without departing from the broad scope of the invention. All such changes and modifications are intended to be included within the scope of the following claims.

I claim:

1. An apparatus for attaching an end closure to a can body where the can body has a wiped down flange about the end to be closed and the end closure has a partially curled edge, comprising:

first means for raising the can body end to be closed together with an end closure atop said end to a position within a punch and curling assembly, said punch and curling assembly being supported in part on support and guide means having an aperture therein for relative travel therethrough of the can body and end closure, second means in the punch and curling assembly, slidable radially inwardly atop said support and guide means, for positioning the curled edge of the end closure to a location adjacent the wiped down flange and the wiped down flange to a location substantially adjacent the surface of said can body, third means in the punch and curling assembly, movable downwardly relative to said second means, for then moving the partially curled edge of the end closure downwardly toward a plurality of curling grooves, said curling grooves forming a substantially annular curling groove when said second means are in their radially innermost position, and fourth means in the punch and curling assembly associated with said third means for bending the edge of the end closure around the substantially annular curling groove and upwardly into the annular slot of said wiped down flange as said third means continues its downward movement.

2. An apparatus as in claim 1 further including means for releasing a can body and end closure after attachment from the punch and curling assembly.

3. An apparatus as in claim 2 in which the releasing means includes means to move the can body upwardly relative to the curling grooves before said curling grooves move radially outward relative to the center line of the punch and curling assembly.

4. An apparatus as in claim 1 in which first means includes an upwardly biased vertically moveable base plate.

5. An apparatus as in claim 1 in which the curled edge and wiped down flange positioning means includes the inner faces of curling fingers slideably mounted on a guide ring arranged and adapted to form a circle concentric with an end closure when in their radial inner positions.

6. An apparatus as in claim 1 in which the curled edge moving means includes a vertically moveable punch member adapted to contact at least the periphery of the upper surface of an end closure.

7. An apparatus as in claim 1 in which the second means includes the substantially vertical inner faces of a plurality of radially slidable curling fingers.

8. An apparatus as in claim 1 in which the fourth means includes, in part, an annular relief extending about the periphery of the third means, arranged and adapted to be substantially in line with said annular curling groove and conformable to a portion of the outer edge of said end closure.

* * * * *